US006109571A

United States Patent [19]

Hirschovits et al.

[11] Patent Number: 6,109,571

[45] **Date of Patent: *Aug. 29, 2000**

[54] MOUSE SUPPORT

[76] Inventors: Adiel Hirschovits, Paasitie 28-32 C, FIN-00830 Helsinki; Robert Skurnik, Ruorikuja 2 D 48, FIN-02320 Espoo; Antti Limingoja, Haukilahdenranta 13 A, FIN-02170 Espoo, all of Finland

[ * ] Notice: This patent is subject to a terminal disclaimer.

[21] Appl. No.: 09/370,828

[22] Filed: Aug. 9, 1999

Related U.S. Application Data

[63] Continuation of application No. 08/557,011, Dec. 7, 1995, Pat. No. 5,984,244.

[51] Int. Cl.[7] ..... B43L 15/00

[52] U.S. Cl. ..... 248/118; 248/118.1; 248/231.71; 248/918

[58] Field of Search ..... 248/118, 118.1, 248/118.5, 118.3, 918, 122.1, 124.1, 125.2, 125.7, 278.1, 282.1, 231.71, 230.6, 229.25

[56] References Cited

U.S. PATENT DOCUMENTS

| | | | |
|---|---|---|---|
| 981,979 | 1/1911 | Collins | 248/289.11 |
| 1,715,715 | 6/1929 | McVey | 211/88.01 |
| 1,801,637 | 4/1931 | Nichols | 248/231.71 |
| 2,227,786 | 1/1941 | La Fee | 312/309 |
| 2,468,473 | 4/1949 | Underwood | 312/194 |
| 2,477,898 | 8/1949 | Rehman et al. | 248/118 |
| 2,510,436 | 6/1950 | Trammell | 108/45 |
| 2,549,753 | 4/1951 | Ashman | 108/45 |
| 2,709,563 | 5/1955 | Starkey | 248/231.85 |
| 3,697,033 | 10/1972 | Jacobs | 248/231.71 |
| 3,746,295 | 7/1973 | Stepanek et al. | 248/447.2 |
| 4,562,987 | 1/1986 | Leeds et al. | 248/278.1 |
| 4,733,618 | 3/1988 | Sarro et al. | 108/140 |
| 4,844,388 | 7/1989 | Kuba et al. | 108/5 |
| 4,974,808 | 12/1990 | Ball | 248/639 |
| 5,228,655 | 7/1993 | Garcia et al. | 248/118 |
| 5,242,139 | 9/1993 | Aldrich | 248/118 |
| 5,379,973 | 1/1995 | Rader | 248/118.1 |
| 5,730,408 | 3/1998 | McAllister et al. | 248/288.51 |

FOREIGN PATENT DOCUMENTS

| | | |
|---|---|---|
| 130733 | 4/1975 | Denmark . |
| 136852 | 8/1952 | Sweden . |
| 190095 | 6/1937 | Switzerland . |
| WO8605974 | 10/1986 | WIPO . |
| WO8900111 | 1/1989 | WIPO . |
| WO9012523 | 11/1990 | WIPO . |
| WO9106233 | 5/1991 | WIPO . |
| WO9114384 | 10/1991 | WIPO . |

*Primary Examiner*—Anita M. King
*Attorney, Agent, or Firm*—Skinner and Associates

[57] ABSTRACT

A mouse support including a unitary plate-like base part, a U-shaped attachment part having an upper leg and a lower leg, and a threaded tightening part. The lower leg has an aperture through which the tightening part extends. The tightening part secures the attachment part to the edge of a plate-like structure. The base part has a portion which overlaps with the lower leg, and further has an aperture through which the tightening part extends. The base part swivels between a use position and a storage position around the tightening part.

7 Claims, 1 Drawing Sheet

MOUSE SUPPORT

This application is a continuation of application Ser. No. 08/557,011, filed Dec. 7, 1995, now U.S. Pat. No. 5,984,244.

This invention concerns a computer mouse support and more specifically a plate-like support on which it is possible to move and store a mouse.

Many types of mouse support are known nowadays. Most commonly they are formed from a plate-like part whose upper surface is covered with a suitable material, on top of which the mouse ball is rolled. They are usually equipped with a raised part whose purpose is to support the wrist of the person operating the mouse. At its most simple, the mouse support is, however, a piece of plastic sheet on which the mouse is moved.

One technical drawback of these mouse supports is their fixed location. Almost without exception the supports are located on top of a table beside a computer keyboard, where they take up space and occupy a specific location until that location is moved. Changing the place of a mouse support by picking it up from the table and relocating it is an awkward task, because sliding the support has usually been made difficult in order to ensure that it stays in place.

The purpose of this invention is to achieve an improvement to the technical drawbacks of mouse supports, and to make a mouse support that may be removed if necessary, but which is easily available and ready to use. In addition, the purpose is to make a mouse support that may be installed in different positions.

The benefits of the invention are accomplished by a solution whose characteristic features are described in the attached claims.

The invention is described in more detail in the following pages with reference to the attached drawings, in which.

Figure 2:
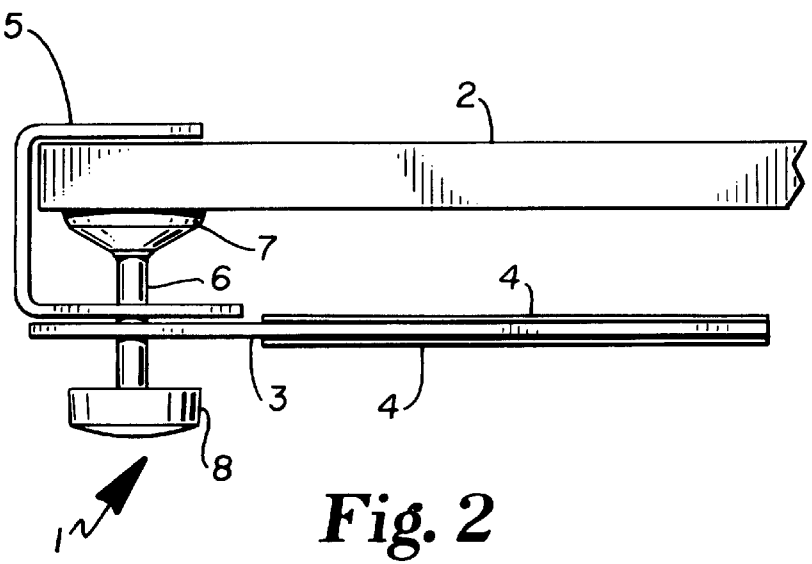
FIG. 2 is a side view of a mouse support in accordance with the invention.
Figure 1:
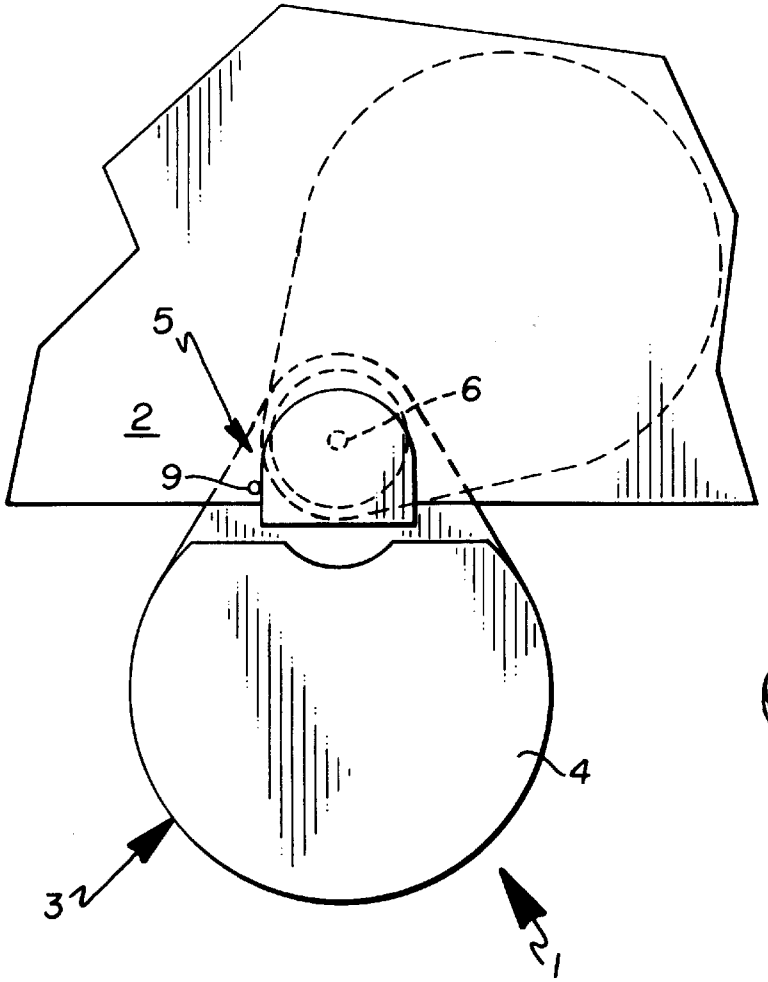
FIG. 1 is a plan view of a mouse support in accordance with the invention seen from directly above.

To get a clear picture of the invention, it is advisable to inspect FIGS. 1 and 2 at the same time. However, the invention shown in the drawings is merely one example of an implement able solution. Other equivalent solutions are certainly possible.

For the sake of clarity, the drawings do not include detailed dimensions and do not show the real situation. Instead, an attempt has been made to depict the parts sufficiently clearly. Because of this, for example, parts which in practice are fixed together have been drawn as being separated from each other.

The mouse support 1 in accordance with the invention is shown in the drawings as being attached to the edge of a table top or a corresponding plate-like structure 2. The mouse support includes the actual base part 3, one side of which or, if needed, both sides of which are covered by a layer 4, made of a suitable material and against which the ball of the mouse can be rolled reliably.

As is best shown in FIG. 2, the base 3 is joined to a U-shaped attachment part 5. A tightening part 6, equipped with a screwing thread, goes through both the base and the U-shaped part. The inner end of the tightening part 6, i.e. the end inside the U-shaped attachment part, is equipped with a protective pad 7, or expanded part or similar, which rests against the under surface of the table top or plate-like structure to which the mouse support is fastened, thus preventing damage to its surface. The other end of the tightening part is equipped with a gripping part 8, sufficiently large to allow it to be gripped and turned and thus to fasten the whole support to the edge of the table top 2, for example.

The U-shaped attachment part 5 and the actual base part 3 are in such a position in relation to each other that the base 3 can be easily and freely rotated to a suitable position in relation to the attachment part 5, and thus it may be rotated to the desired working position from its storage position under the table top 2 for example. FIG. 1 shows, as an example, a stopping pin 9, which ensures the movement stops at the desired position. Pins, or other stopping devices, may be used to limit the movement of the base 3 in both directions, or they may be omitted.

The mouse support 1 in accordance with the invention must be installed so that either the base part is under the level of the table top or corresponding structure or, after turning it 180°, is above the table top, according to choice or need.

It is to be further noted that a mouse support in accordance with the invention must be located in relation to the attachment part in such a way that, if the base has been installed for rotation under the table top, for example, there should be enough space for the mouse resting on the base to fit in the area between the table top 2 and the base 3. Thus the mouse may be brought out, used and returned easily and effortlessly.

A useful way of making a simple and beneficial attachment between the attachment part 5 and the base 3 is to equip both parts with a hole having an internal thread corresponding to the external thread of the tightening part 6. The mouse support may be arranged so that when the base 3 is rotated to the desired extreme position, it will rotate on the thread of the tightening part 6 until it tightens against the surface of the attachment part 5 at the same point as its desired position. Thus an automatic stopper is formed for the rotating movement.

It is possible to achieve rotation of the base 3 around the attachment part 5, while at the same time ensuring that the parts stay in place, in many different ways that are familiar to professionals in different fields.

As mentioned above, both sides of the base 3 may be equipped with a suitable surface material. This is because both sides may be used as the resting base for the mouse depending on whether the base is installed above or below the table top.

Figure 3:
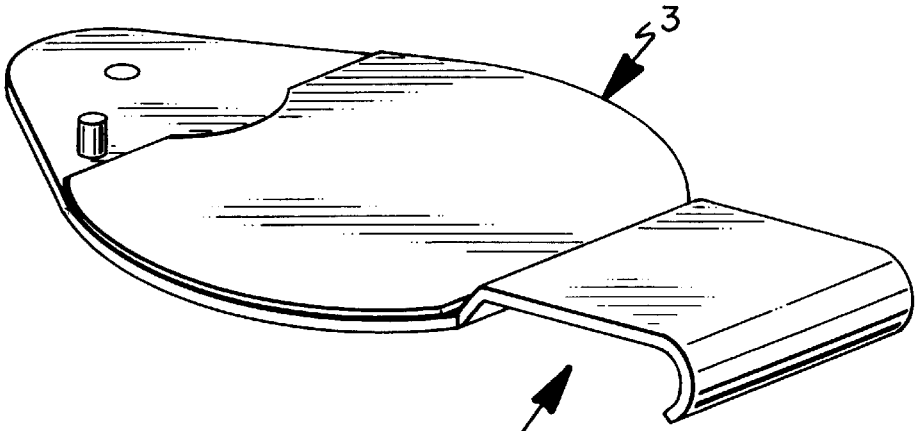
FIG. 3 shows a certain variation of a support in accordance with the invention.

FIG. 3 shows a certain variation of the base part 3 in which a wrist support 10 has been attached to the base part. In accordance with the invention this has been done in such a way that the base plate 3 has been bent into a structure rising above the level of the base, on which the wrist may rest when working with the mouse. It is clear that a wrist support may also be arranged in a normal way by using a raised cushion. The wrist support part may be made from a suitable material or may be covered with it.

The appropriate manufacturing material of the actual base part 3 in accordance with the invention and also of the attachment part 5 is a plastic-based material, although other materials may also be used. The attachment part can suitably be made from metal or a combination of plastic and metal. The tightening part 6 is suitably made from metal. For aesthetic or other reasons, the surfaces of a mouse support in accordance with the invention may be equipped with prints, stickers or corresponding covering parts, or the surfaces may be painted or otherwise surface treated.

What is claimed is:

1. A mouse support, comprising:

(a) a base part having a unitary, plate-like form adapted for enabling a mouse to be operably moved on said base part, said base part having two sides, at least one of said two sides being covered with a suitable material against which a mouse ball can be reliably rolled, said base part including an attachment portion formed as an integral part of said unitary, plate-like base part; and (b) an attachment part adapted for securing said base part to a plate-like structure, said attachment part including a body connected to said attachment portion of said base part at a swivel point, said body including a first leg and a second leg, said body being adapted to receive said plate-like structure between said first leg and said second leg, said base part rotating about said swivel point between a using position and a storage position.

2. The mouse support of claim 1, wherein said attachment part is adapted for positioning said base part to rotate beneath said plate-like structure into said storage position.

3. The mouse support of claim 1, wherein said attachment part is adapted for positioning said base part to rotate above said plate-like structure into said storage position.

4. The mouse support of claim 1, wherein each of said two sides of said base part is covered with a suitable material against which a mouse ball can be reliably rolled.

5. A mouse support, comprising:

(a) a base part having a unitary plate-like form adapted for enabling a mouse to be operably moved on said base part, said base part having two sides, at least one of said two sides being covered with a suitable material against which a mouse ball can be reliably rolled, said base part including an attachment portion formed as an integral part of said unitary, plate-like base part;

(b) an attachment part adapted for securing said base part to a plate-like structure, said attachment part including a body connected to said attachment portion of said base part at a swivel point, said base part rotating about said swivel point between a using position and a storage position, said body including a first leg and a second leg, said body being adapted to receive said plate-like structure between said first leg and said second leg; and (c) a tightening part adapted for securing said body of said attachment part to said plate-like structure, said tightening part securing said plate-like structure between said first leg and said second leg.

6. The mouse support of claim 5, wherein said tightening part forms said swivel point.

7. A mouse support, comprising:

(a) a base part having a unitary, plate-like form adapted for enabling a mouse to be operably moved on said base part, said base part having two sides, at least one of said two sides being covered with a suitable material against which a mouse ball can be reliably rolled, said base part including an attachment portion formed as an integral part of said unitary, plate-like base part;

(b) an attachment part adapted for securing said base part to a plate-like structure, said attachment part including a body connected to said attachment portion of said base part at a swivel point, said base part rotating about said swivel point between a using position and a storage position, said body including a first leg and a second leg, said body being adapted to receive said plate-like structure between said first leg and said second leg; and (c) a tightening part adapted for securing said plate-like structure between said first leg and said second leg.

* * * * *